US005936652A

United States Patent [19]

Narayan et al.

[11] Patent Number: 5,936,652

[45] Date of Patent: Aug. 10, 1999

[54] APPARATUS FOR PROTECTING A LENS ARRAY OF A PRINTHEAD USED FOR COPY RESTRICTIVE DOCUMENTS

[75] Inventors: Badhri Narayan, Rochester; Robert C. Bryant, Honeoye Falls; David J. Nelson, Rochester; Laurie L. Voci, Farmington, all of N.Y.

[73] Assignee: Eastman Kodak Company, Rochester, N.Y.

[21] Appl. No.: 08/904,111

[22] Filed: Jul. 31, 1997

[51] Int. Cl.[6] ..... B41J 2/235

[52] U.S. Cl. ..... 347/136; 347/263; 347/14; 347/23; 399/114; 399/207

[58] Field of Search ..... 347/16, 23, 136, 347/152, 257, 263; 396/448; 399/1, 2, 114, 207

[56] References Cited

U.S. PATENT DOCUMENTS

| | | | |
|---|---|---|---|
| 5,032,005 | 7/1991 | Woodruff | 359/230 |
| 5,192,973 | 3/1993 | Hickisch | 347/130 |
| 5,237,347 | 8/1993 | Teshigawara et al. | 347/130 |

FOREIGN PATENT DOCUMENTS

| | | | |
|---|---|---|---|
| 3635420C1 | 3/1988 | Germany | B41J 3/04 |
| 3-221473 | 9/1991 | Japan | B41J 2/45 |

*Primary Examiner*—N. Le
*Assistant Examiner*—Hai C. Pham
*Attorney, Agent, or Firm*—Nelson Adrian Blish; David A. Novais

[57] ABSTRACT

According to one aspect of the present invention, there is provided a printhead protective cover (50) which includes a shutter blade (60), an actuator (70) for moving the shutter blade (60), and a light trap (54) to prevent light from the printhead (12) from passing around the shutter blade (60). In one embodiment, a sensor detects a position of the shutter blade (60) and sends a signal to shutoff the actuator (70) when the shutter blade (60) is in an open position, or the shutter blade (60) is in a closed position. In yet another embodiment, the actuator (70) closes the shutter blade (60) in response to a tear in a web or failure of a dryer. In a further embodiment, the shutter blade (60) slides on a base plate coated with a low friction, non-volatile, non-liquid material, and the shutter blade (60) slides at an oblique angle on the base plate.

16 Claims, 5 Drawing Sheets

APPARATUS FOR PROTECTING A LENS ARRAY OF A PRINTHEAD USED FOR COPY RESTRICTIVE DOCUMENTS

CROSS REFERENCE TO RELATED APPLICATIONS

The present application is related to U.S. application Ser. No. 08/593,772, filed Jan. 29, 1996, by Jay S. Schildkraut, et al, titled "Copy Protection System"; U.S. application Ser. No. 08/598,785, filed Feb. 8, 1996, by John Gasper, et al, titled, "Copy Restrictive Documents"; U.S. application Ser. No. 08/598,446, filed Feb. 8, 1996, by Xin Wen, titled, "Copyright Protection in Color Thermal Prints"; U.S. application Ser. No. 08/598,778, filed Feb. 8, 1996, by John Gasper, et al, titled, "Copy Restrictive System."; and U.S. application Ser. No. 08/846,387; filed Apr. 30, 1997, by John Gasper, et al, titled "Apparatus for Creating Copy Restrictive Media".

FIELD OF THE INVENTION

The invention relates generally to the field of restricting the copying of copyrighted material, and in particular to an apparatus for protecting the lens array on a LED (light emitting diode) printhead.

BACKGROUND OF THE INVENTION

Copying of documents has been performed since the first recording of information in document form. Documents are produced using many procedures on many types of substrates and incorporate many forms of information. Unauthorized copying of documents has also been occurring since the storage of information in document form first began. For much of the history of information documentation, the procedures used to copy original documents have been sufficiently cumbersome and costly to provide a significant impediment to unauthorized copying, thus limiting unauthorized copying to original documents of high value. However, in more recent times the introduction of new technologies for generating reproductions of original documents has decreased the cost and inconvenience of copying documents, thus increasing the need for an effective method of inhibiting unauthorized copying of a broader range of restricted documents. The inability of convenient, low-cost copying technologies to copy original documents containing color or continuous tone pictorial information restricted unauthorized copying primarily to black-and-white documents containing textual information and line art. Recently, the introduction of cost effective document scanning and digital methods of signal processing and document reproduction have extended the ability to produce low cost copies of original documents to documents containing color and high quality pictorial information. It is now possible to produce essentially indistinguishable copies of any type of document quickly, conveniently, and cost effectively. Accordingly, the problem of unauthorized copying of original documents has been extended from simple black-and-white text to color documents, documents containing pictorial images, and photographic images. In particular, restricting the unauthorized duplication of photographic images produced by professional photographers on digital copying devices has recently become of great interest.

U.S. application Ser. No. 08/598,778, filed Feb. 8, 1996, by John Gasper, et al, titled "Copy Restrictive System" and U.S. application Ser. No. 08/598,785, filed Feb. 8, 1996, by John Gasper, et al, titled "Copy Restrictive Documents" disclose pre-exposing color photographic paper to spots of blue light to produce an array of yellow microdots after chemical processing, and a method of detecting these microdots during scanning performed by a digital printing device. Detecting these microdots in original photographs prevents unauthorized copying of the photographs. There are, however, difficulties in getting the correct pattern of microdots incorporated in photographic paper.

Methods of exposing light-sensitive photographic media for the purpose of writing an image to the media are well-known in the art. Devices that write to the media by scanning a beam of light in raster fashion across the media are called flying spot scanners. These include cathode ray tubes (CRTs) and laser scanners. The intensity of the light beam is modulated in any of a number of ways during the scanning of the beam across the media. The image being written to the media is presented to the media as a continuous signal and the image occupies the full area of the media. The duty cycle of the light source expressed as a percentage of the time the light is on and being modulated in intensity is typically 100 percent. Such scanning printers are not designed for efficiently exposing photographic media to a sparse array of microdots requiring a duty cycle of less than 10 percent and preferably less then 5 percent. Although a laser scanner can use a pulsed laser to scan an image of low duty cycle, they occupy a large volume, are expensive to build, operate, and maintain, and are designed to scan only across a limited length of scan line usually measured in inches and not feet when the writing spot size is submillimeter in diameter.

One attempt to solve this problem is disclosed in copending U.S. application Ser. No. 08/846,387, filed Apr. 30, 1997, titled "Apparatus for Creating Copy Restrictive Media", which incorporates a linear array comprised of at least two spatially distributed light sources and an aperture mask for forming two or more micro-light sources from the light sources. An optical element focuses light from the micro-light sources onto a media moving relative to the linear array. An encoding device turns the light sources on and off at regular intervals relative to movement of the media. A potential problem with this arrangement is that the optical element is located in close proximity to a rapidly moving web of material. Breaks in the web of material can scratch or damage the optical element. Also, a web dryer associated with the moving web may fail and cause the optical element to be splattered with material, thus reducing the efficiency of the optical element.

Since this type of apparatus may be producing some photographic paper which does not incorporate the copy restrictive microdots, it is often necessary to turn off the microlight sources. However, once the microlight sources are turned off, it requires a significant amount of time to warm up the microlight sources to a steady state temperature to produce microdot patterns of the right intensity. Thus, it would be desirable to incorporate microlight sources, which may remain on when photographic paper without a copy restrictive pattern is in production without exposing the photographic paper to the microlight sources. It is also desirable that this type of printhead be compact and fit into the tight confinement of existing coating machines for photographic paper without costly retrofitting and allow for the exposure of the full width of the web.

SUMMARY OF THE INVENTION

An object of the present invention is to provide an apparatus to efficiently expose photographic media to a sparse array of microspots of colored light with precise two-dimensional spacing, intensity, and size.

Another object of the invention is to provide a printhead protective cover which operates in a limited space to protect an optical element without contaminating a fast moving web of material.

An additional object of the invention is to provide a printhead protective cover which completely blocks all light from an optical element when a shutter blade is closed.

The present invention is directed to overcoming one or more of the problems set forth above. Briefly summarized, according to one aspect of the present invention, there is provided a printhead protective cover comprising a shutter blade, an actuator for moving the shutter blade, and a light trap to prevent light from the printhead from passing around the shutter. In one embodiment, a sensor detects a position of the shutter blade and sends a signal to shutoff the actuator when the shutter is in an open position or the shutter is in a closed position. In yet another embodiment, the actuator closes the shutter in response to a tear in a web or failure of a dryer. In the preferred embodiment, the shutter slides on a base plate coated with a low friction, non-volatile, non-liquid material, and the shutter slides at an oblique angle on the base plate.

These and other aspects, objects, features, and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
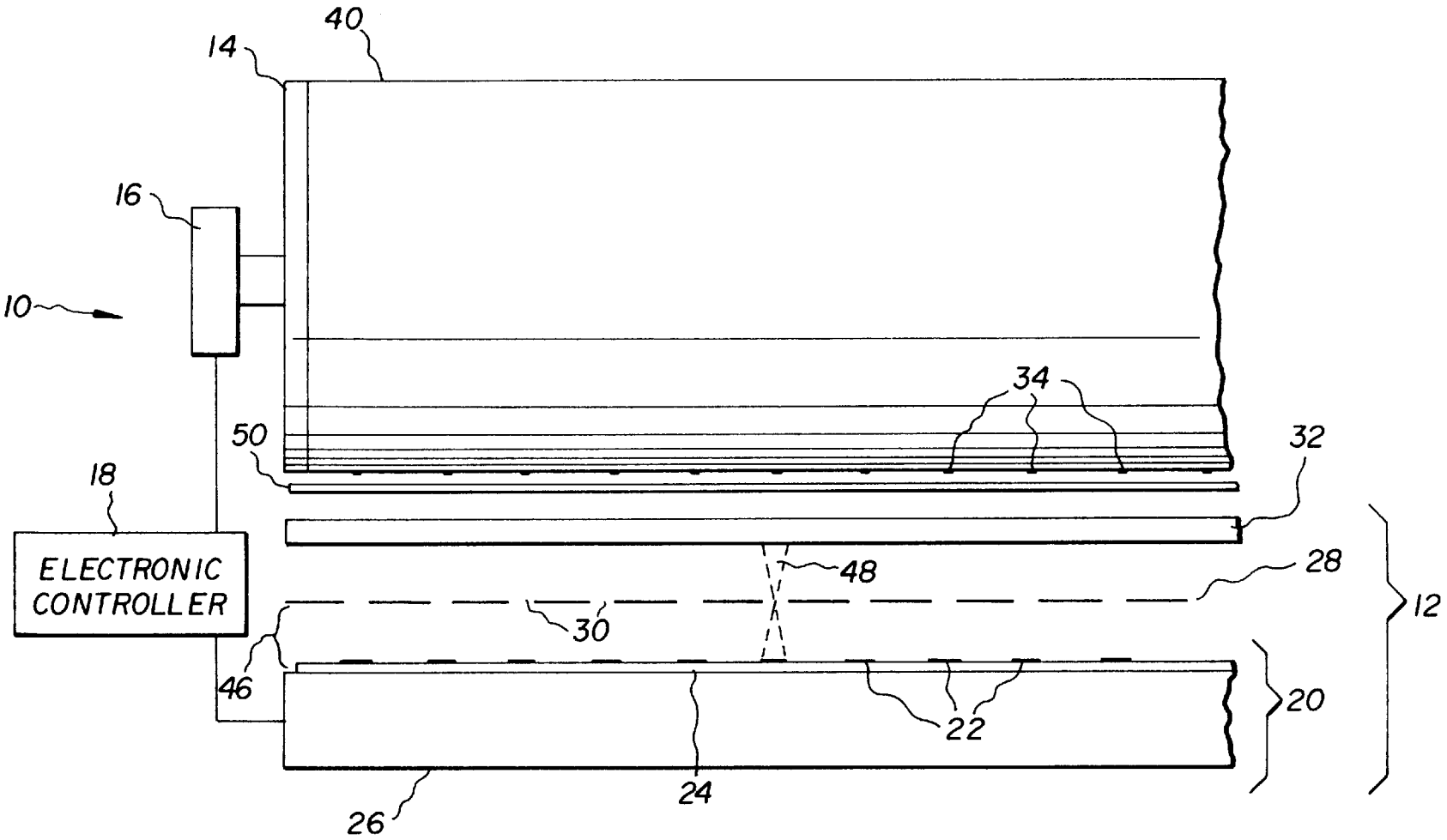
FIG. 1 is a plan view of an apparatus with a linear array of light emitting diodes (LED) according to the present invention.

Referring to FIG. 1, in its most general implementation, the inventive apparatus 10 imparts to color photographic media and in particular color photographic paper a means of copyright protection. Apparatus 10 is comprised of a printhead 12, drum 14, encoder 16, and electronic controller 18.

Printhead 12 is comprised of a linear array of light sources 20, aperture mask 28, and lens array 32. The linear array of light sources 20 is composed of spaced, light emitting sources 22 such as inorganic or organic light-emitting diodes (LEDs) or laser diodes, that emit predominantly blue light in the range of wavelengths from 400 to 500 nanometers. The light emitting sources 22 are mounted on a ceramic heat sink 24 which in turn is mounted on to a rigid metal base mount 26. Each of the light emitting sources 22 are separated from each adjacent source by at least 0.5 mm and preferably 2 mm. Each light emitting source has a maximum linear dimension of 0.3 mm, and preferably less than 0.2 mm.

Figure 2:
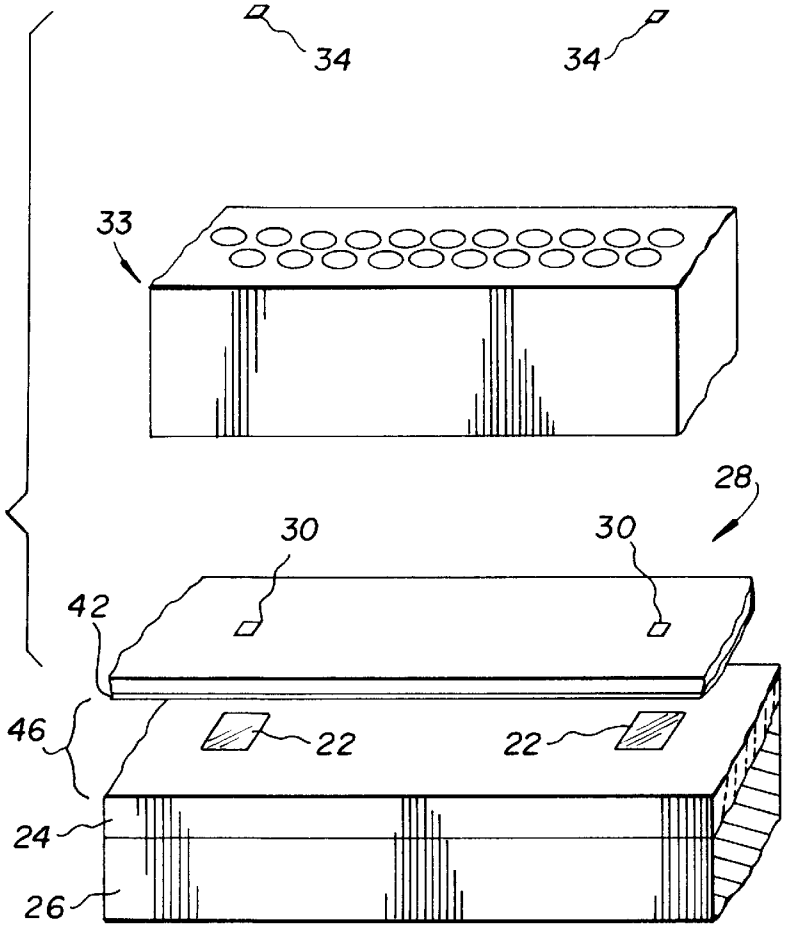
FIG. 2 is a perspective view of lens array and aperture mask for the apparatus shown in FIG. 1.

As shown in more detail in FIG. 2, the light from each light source 22 illuminates an appropriate aperture 30, in aperture mask 28, placed over each light source 22. The illuminated aperture is then imaged by a lens array 32 to a light sensitive media or web 40. In the preferred embodiment, lens array 32 is a gradient-index rod lens array 33 sold under the trademark Selfoc™, made by NSG America. In an alternate embodiment lens array 32 is a microlens array 35 of the type shown in FIG. 3.

Each aperture 30 in the aperture mask 28 is used to restrict the area of the emitted light that is being imaged onto the light sensitive media 40 so as to form a micro-spot 34 of focused light of a desired size on the media 40. Each aperture 30 is separated from each adjacent aperture by at least 0.5 mm and preferably 1 mm. Each aperture has a maximum linear dimension of 0.2 mm, and preferably less than 0.1 mm. A center of each aperture in the aperture mask is aligned coaxially with a center of each light source. After chemical processing of the exposed media, a colored microdot is formed in the color photographic media.

Figure 3:
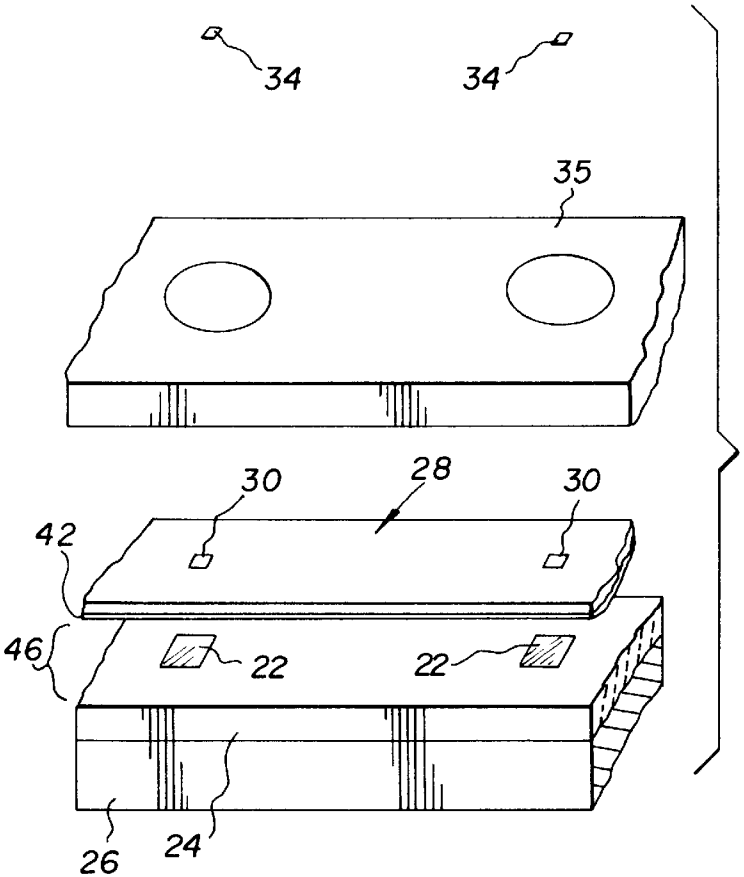
FIG. 3 is a perspective view of an alternate embodiment of a lens array for the apparatus shown in FIG. 1.

Aperture mask 28 is separated from the linear array of light sources 20 by a gap 46 shown in FIG. 1–3. In the preferred embodiment gap 46 is at least 0.1 mm. Gap 46 provides a reduction in the angle 48 subtended by the light passing through the aperture, thereby reducing the working numerical aperture of the imaging optics to provide a sharper image with less flare and increased depth-of-focus than would otherwise be possible.

The aperture mask may be coated with a filter material 42 that provides spectral filtration to block unwanted wavelengths of light. Filter material 42 may be placed anywhere between light sources 22 and the lens array 32. In one embodiment filter material is a multi-layer, dielectric, interference filter, and is coated on one surface of aperture mask 28.

The separation of the light emitting sources 22, and the concomitant separation of the apertures 30, determines the spacing between the micro-spots 34 of blue light in a transverse direction i.e. across the width of the media 40. To control the precise placement of micro-spots 34 in a longitudinal direction, a high resolution encoder 16 is mounted on drum 14. The drum 14 transports media 40. Encoder pulses are counted by electronic controller 18 to generate electrical timing signals necessary to pulse the linear array of light sources 20 at a precise pulse duration at precise intervals of time. For a given radiant power emitted by the light sources 22, the duration of the pulse (the time that the light source is on) is variable to obtain a desired exposure on the photographic media. The encoder 16 provides precise timing pulses irrespective of any media flutter, which enables precise location of the microdots at a desired pitch in the longitudinal direction. In some embodiments, it is desirable to keep the pitch of the micro-spots along the transverse and longitudinal directions the same.

By controlling the light pulse duration, the radiant power output from the light emitting sources 22, and the size of the aperture 30, a size and intensity of the micro-spot is controlled. The resulting controlled exposure received by the photographic media results in a two-dimensional array of micro-spots of desired size and exposure to the media. After chemical processing of the media there is formed in the media colored microdots of the desired size, spacing, and optical density.

One of the important attributes of the present invention is the precise placement of the micro-spots of focused light onto the media. After exposure and chemical processing of silver halide photosensitive media, an image subsequently recorded by an end user will contain microdots of the same spacing. This photographic print is rendered copy restrictive. When an attempt is made to copy the print using a digital printing station, detection means for identifying the unique pattern of microdots enables preventing operation of the digital print station. An important aspect of this detection means is the performance of a Fourier transform to identify the spatial frequency or frequencies of the two-dimensional pattern. Without accurate positioning of the micro-spots of light onto the media with adequate precision and repeatability of location, as well as maintaining a constant radiant energy for all micro-spots for all exposed media, it would be far more difficult to develop a robust software algorithm having a high probability of detecting a pattern that identifies the media as copy restrictive when this pattern is accompanied by a complex scene imparted to the media by the end user.

A other important aspect of the present invention is maintaining an equal radiant energy to the media for all micro-spots. In the preferred embodiment employing LEDs, an aperture mask, and a Selfoc™ array, it is necessary to adjust the applied voltage to each LED in order to obtain an equal energy exposing the media. This is in part due to variations in the operating characteristics from one LED to another, variation in the open area of the apertures from one aperture to another, and a variation in the brightness of the Selfoc™ image when the position of each micro-light source varies with respect to the spatial arrangement of the gradient-index rod lenses in the Selfoc™ linear array.

Another important feature of the present invention is the exposure of the media with a sparse array of micro-spots covering typically less than 1% of the surface area. This is necessary to prevent an increase in the minimum optical density of the media. Therefore, the duty cycle of the light sources, i.e., the fraction of the time the light source is on and exposing the media is very low, typically less than 5%. This low duty cycle provides extended operating life for the LEDs or laser diodes.

Figure 4:
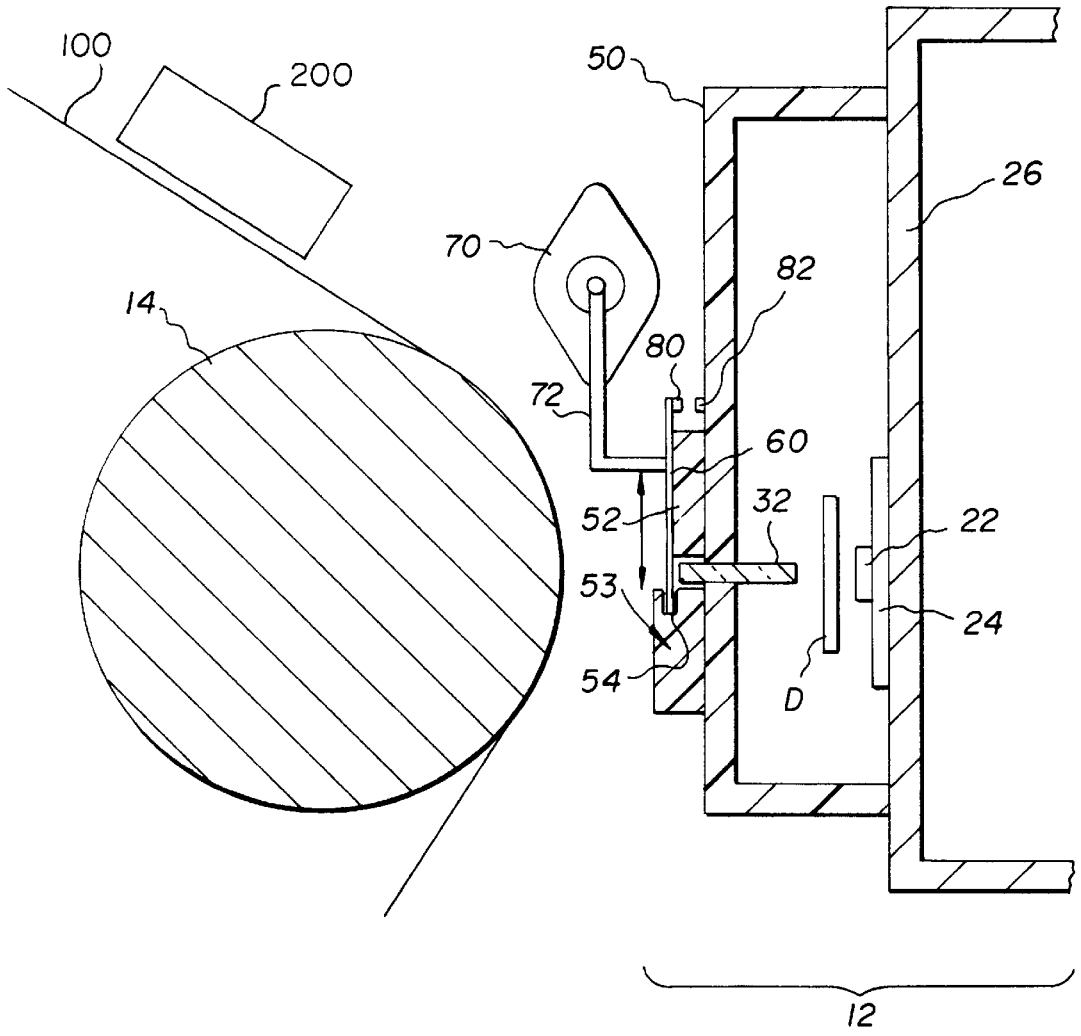
FIG. 4 is a cross-sectional view from the side of a printhead protective cover according to the present invention.

FIG. 4 shows modifications to the printhead shown in FIG. 1 to protect the printhead lens array 32. Two guard rails 52 and 53 are attached to the printhead cover 50. These rails are close to the lens array 32. The rails 52 and 53 proximity to the lens array 32 is adjustable. The rails 52 and 53 protrude past the lens array 32 by short distance.

The bottom rail 53 protrudes past the top rail 52 by an additional length to accommodate a light trap 54 to hold the shutter blade 60 in place when the printhead is not in use. The shutter blade 60 covers the full length of the lens array 32 and is a attached to an actuator 70. In the preferred embodiment, actuator 70 is a motor. Motor 70 is connected to shutter blade 60 through linkage 72. The position of the shutter blade 60 is detected by a magnet 80 and a Hall effect sensor 82.

In operation, the printhead is turned on which energizes all the electrical controls associated with the printhead. The shutter blade 60 is actuated to move it to an open position, thus exposing a web or paper 100 (FIG. 4) to the lens array 32 of the printhead. The shutter position is sensed by the Hall effect sensor 82 and enunciated to an operator. When the microdot exposure system is not needed the printhead is de-energized and the shutter blade 60 is moved to the close position thus protecting the head from contamination.

If a dryer 200 (FIG. 4) used for drying the emulsion on the paper is not operating properly, the wet emulsion on the paper will spray on the head and degrade the performance of the printhead. A temperature sensor, not shown, located in the dryer chamber can detect the malfunctioning of the dryer 200 and actuate the motorized shutter mechanism, causing the shutter blade 60 to move to the closed position, thus protecting the lens array 32 from contamination by the wet emulsion.

During the manufacturing process it is often necessary to alternate production runs incorporating a microdot pattern with production runs which do not incorporate a microdot pattern. Since the production run, which does not incorporate the microdots, may run for an hour or less, and the warm-up time for the printhead lasts more than an hour, it is advantageous to leave the printhead energized. To do this, light from the printhead must be prevented from reaching the photographic media, or the photographic media will be exposed. To do this, one embodiment of the present invention incorporates a light trap 54 in the form of a slot in lower guard rail 53 to insure no light from the printhead escapes past shutter blade 60. Light trap 54, in one aspect of the invention, may be coated with black light-absorbing paint.

Figure 5:
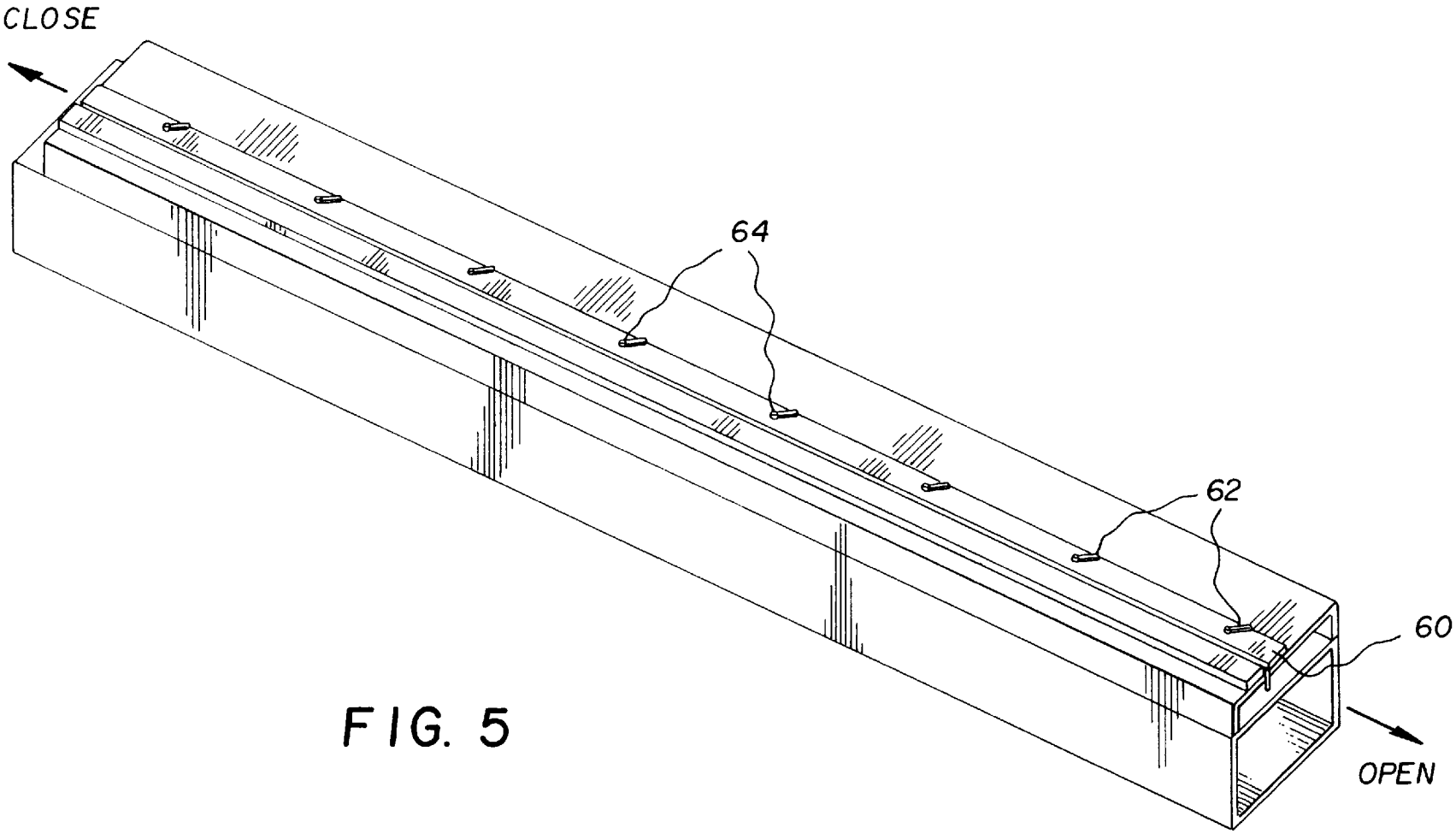
FIG. 5 is a perspective view of a printhead protective cover showing the shutter mechanism.
Figure 6:
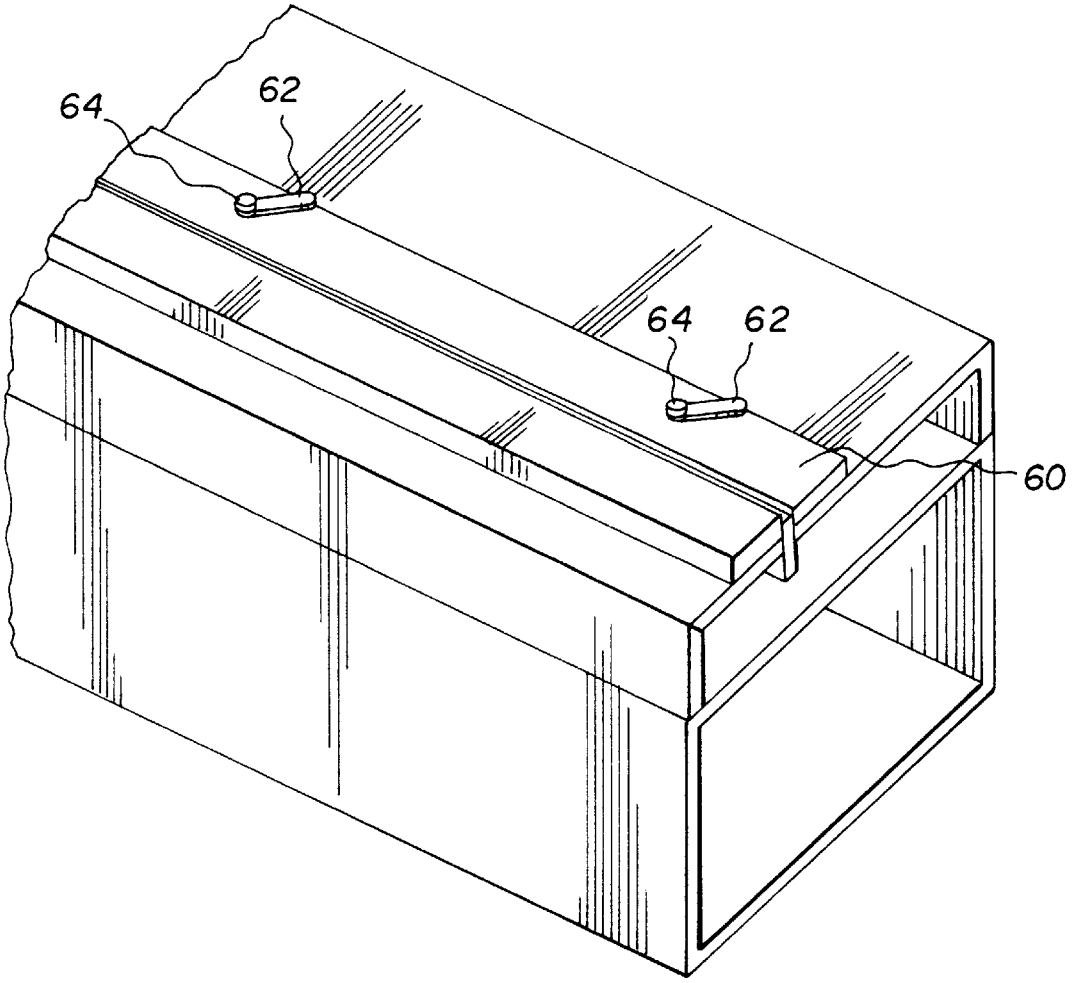
FIG. 6 is a perspective view of the print head protective cover shown in FIG. 5 with the shutter mechanism in the open position.

FIGS. 5 and 6 show printhead cover 50. Shutter blade 60 is moved up and down by use of guides 62. As shutter blade 60 is moved right to the open position, guides 62, along with pins 64, cause shutter blade 60 to move in an upward direction.

At least one face of upper guard rail 52 is coated with a low friction, non-volatile, non-liquid material, such as Teflon™. This allows shutter blade 60 to slide along the face of upper guard rail 52 with little friction. The face of shutter blade 60 in contact with upper guard rail 52 may also be coated with Teflon™, or a similar material.

The invention has been described in detail with particular reference to certain preferred embodiments thereof, but it will be understood that variations and modifications can be effected within the spirit and scope of the invention.

PARTS LIST

| | |
|---|---|
| 10 | apparatus |
| 12 | printhead |
| 14 | drum |
| 16 | encoder |
| 32 | lens array |
| 50 | protective cover |
| 52 | top guard rail |
| 53 | bottom guard rail |
| 54 | light trap |
| 60 | shutter blade |
| 62 | guides |
| 64 | pins |
| 70 | actuator/motor |
| 72 | linkage |
| 80 | magnet |
| 82 | Hall effect sensor |

What is claimed is:

1. A printhead protective cover comprising:

a shutter blade;

an actuator for moving said shutter blade; and a light trap to prevent light from a light source of said printhead from passing around said shutter blade;

wherein said printhead is adapted to image light from said light source on a web and said actuator closes said shutter blade in response to a tear in said web.

2. A printhead protective cover as in claim 1 wherein a sensor detects a position of said shutter blade and sends a signal to shutoff said actuator when said shutter blade is in an open position.

3. A printhead protective cover as in claim 1 wherein a sensor detects a position of said shutter blade and sends a signal to shutoff said actuator when said shutter blade is in a closed position.

4. A printhead protective cover as in claim 1 wherein said actuator is an electric motor.

5. A printhead protective cover as in claim 1, further comprising first and second guide rails attached to said printhead cover, one of said first and second guide rails comprising a slot which defines said light trap.

6. A printhead protective cover as in claim 5, wherein said slot further holds said shutter blade in place when said shutter blade is in a closed position.

7. A printhead protective cover as in claim 1, wherein said shutter blade slides on a base plate.

8. A printhead protective cover as in claim 7, wherein said shutter blade and said base plate are both coated with a low friction non-volatile, non-liquid material.

9. A printhead protective cover as in claim 7, wherein said shutter blade slides at an oblique angle on said base plate.

10. A printhead protective cover comprising:

a shutter blade;

an actuator for moving said shutter blade; and a light trap to prevent light from a light source of said printhead from passing around said shutter blade;

wherein said printhead is adapted to image light from said light source onto light sensitive media, said light sensitive media is subjected to a drying by a dryer prior to reaching said printhead, and said actuator closes said shutter in response to an incomplete drying of said light sensitive media by said dryer.

11. A printhead protective cover as in claim 10, wherein said shutter blade slides on a base plate.

12. A printhead protective cover as in claim 11, wherein said shutter blade and said base plate are both coated with a low friction non-volatile, non-liquid material.

13. A printhead protective cover as in claim 11, wherein said shutter blade slides at an oblique angle on said base plate.

14. An apparatus for creating copy restrictive media comprising:

a linear array comprised of at least two spatially distributed light sources;

an aperture mask for forming two or more micro-light sources from said light sources;

an optical element for focusing light from said micro-light sources onto a media moving transverse to said linear array;

an encoder for turning said light sources on and off at regular intervals relating to movement of said media; and a printhead protective cover located between said optical element and said media comprising:

a shutter blade;

an actuator for moving said shutter blade;

a light trap to prevent light from said light sources from passing around said shutter blade; and first and second guide rails attached to said printhead cover, one of said first and second guide rails comprising a slot which defines said light trap.

15. An apparatus as in claim 14, wherein said slot further holds said shutter blade in place when said shutter blade is in a closed position.

16. An apparatus as in claim 14, wherein said shutter blade covers a full length of said linear array.

* * * * *